United States Patent [19]

Davis

[11] 4,190,024

[45] Feb. 26, 1980

[54] VARIABLE CHAMBER DIESEL ENGINE

[76] Inventor: Robert Davis, 125 Welch's Point Rd., Milford, Conn. 06460

[21] Appl. No.: 817,691

[22] Filed: Jul. 21, 1977

[51] Int. Cl.[2] ..... F02B 75/04

[52] U.S. Cl. ..... 123/48 A; 123/78 A

[58] Field of Search ..... 123/48 R, 48 A, 48 AA, 123/78 B, 78 A, 1 R, DIG. 1, DIG. 6, DIG. 7

[56] References Cited

U.S. PATENT DOCUMENTS

| | | | |
|---|---|---|---|
| 2,142,466 | 1/1939 | Wagner | 123/48 A |
| 2,821,967 | 2/1958 | Teegen | 123/48 A |
| 3,354,790 | 11/1967 | Race | 123/48 A |

FOREIGN PATENT DOCUMENTS

| | | | |
|---|---|---|---|
| 921400 | 5/1947 | France | 123/48 A |

*Primary Examiner*—Ira S. Lazarus

*Attorney, Agent, or Firm*—Blum, Kaplan, Friedman, Silberman & Beran

[57] ABSTRACT

A two-cycle diesel engine comprising a diesel head and a combustion chamber whose size is variable upon movement of a flexible fluorocarbon membrane. The diesel engine has an engine cylinder in which a reciprocating piston is disposed. The combustion chamber is positioned above the piston and bounded on top by the membrane. Since fuel ignition occurs because of the heat from the compression of air in the combustion chamber, the rate of firing of the engine can be altered by changing the chamber's size. This is accomplished by a flexing and unflexing movement of the membrane which is selectively controlled by a contra piston and screw mounted in the diesel head above the membrane.

26 Claims, 3 Drawing Figures

VARIABLE CHAMBER DIESEL ENGINE

BACKGROUND OF THE INVENTION

This invention relates to a two-cycle diesel engine of the type commonly used in connection with models and other small devices.

The two-cycle diesel engine is known in the prior art and has been used, principally in Europe, in the flying model field for quite a number of years. This type of diesel engine provides a broad range of power while producing comparatively little noise. At the same time, it is very economical to operate. Basically, the principal difference between the operation of the diesel and that of the standard glow-plug engine is that the diesel does not employ a spark plug or glow plug to ignite the fuel. Instead, fuel combustion in the diesel occurs due to the heat created by the high compression of air within the engine.

Timing or rate of firing in the diesel is determined by the relative size of a variable combustion chamber. As the size of the combustion chamber is reduced from its maximum, the amount of heat is correspondingly increased, and the firing becomes more rapid until an optimum operational condition is reached. To accomplish this variation in the combustion chamber size, many of these types of prior art diesel engines employ a metal contra piston fitted in an engine cylinder above a piston. The contra piston in the prior art actually forms the top of the combustion chamber, and its position is adjustable with respect to the actual piston itself. The adjustment is usually made by a lever or a screw. Although the contra piston must be movable with respect to the piston to permit adjustment in the size of the combustion chamber, it must at the same time provide a good seal with the engine cylinder to prevent any gas leakage which would reduce compression and efficiency. This problem is further complicated by the fact that heat from engine operation will cause the contra piston to expand and a too closely fitted contra piston might become locked in place and be useless in adjusting the firing rate. Therefore, the contra piston in the prior art diesel engines and the corresponding engine cylinders must be machined very accurately to minute tolerances, and this is extremely expensive.

Conversion of the common glow plug or spark-ignition engine to a diesel engine has also been accomplished in the prior art. There, a cylindrical liner is installed inside an engine cylinder. The liner contains a close-fitting but movable contra piston which operates in the same manner as previously described to adjust the size of the combustion chamber. Again, expense is the major factor as the contra piston and the liner must be fabricated to extreme tolerances.

As a further drawback, most prior art two-cycle diesel engines have no built in safety feature to permit gas to escape should the engine severely overheat. Therefore, if this condition does occur, the expensive prior art diesel engine may explode or at least be extensively damaged.

Finally, due to their design characteristics, the displacement of these prior art diesel engines is considered to be very limited. This is because of the fact that as displacement increases, the amount of surface area in the combustion chamber also increases. Consequently, the heat loss from the combustion chamber through the surface area of the engine cylinder and contra piston becomes great. Efficiency is reduced, and the engine does not run smoothly.

Therefore, despite their performance advantages over the conventional glow-plug engine, because of their expense, unsafe operation possibilities and limited size, the prior art two-cycle diesel engines are not widely used in the United States.

SUMMARY OF THE INVENTION

The diesel engine according to the invention herein is easily and inexpensively fabricated as it does not require the exacting parts tolerances found in the prior art diesel engines. At the same time, existing glow-plug engines can easily be converted to the diesel engine of this invention which also has less of a chance of engine damage due to overheating than prior art diesels. Further, this diesel engine is more efficient than prior art diesels and, therefore, not as restricted in its displacement.

The diesel engine of this invention comprises a diesel head which fits on an engine cylinder directly above a combustion chamber and a piston. The bottom side of the piston opposite the combustion chamber is attached to a shaft by means of a connecting rod. When fuel is ignited in the combustion chamber, it moves the piston which in turn causes the shaft to rotate. In model airplane use, a propeller would be concentrically mounted on the shaft and thus, upon rapid rotation of the shaft, provide the thrust to fly the plane.

A disc-shaped fluorocarbon membrane is mounted above the combustion chamber and secured in place between the combustion chamber and the diesel head. The membrane acts as the top of the combustion chamber and completely seals the chamber from the diesel head. A contra piston is movably disposed inside the diesel head, and it rests on top of the membrane opposite the combustion chamber. The contra piston can be forced downward against the membrane by the rotation of a compression screw mounted on the diesel head. As the membrane is flexible, movement of the contra piston in the direction of the combustion chamber will cause a similar movement in the membrane. This movement of the membrane decreases the size of the combustion chamber and thereby raises its internal temperature.

As with other diesels, fuel ignition occurs in the combustion chamber because of the compression heat available there. The smaller the size of the combustion chamber, the greater the amount of heat present. As the rate of firing is proportional to this amount of heat, engine speed can be varied by rotating the compression screw thereby altering the size of the chamber because of the contra piston's effect on the flexible membrane as previously described. Accordingly, unlike the prior art diesel engine, the contra piston of this invention does not have to maintain a gas tight fit with the sides of the engine as the combustion chamber seal is maintained by the flexible membrane. Therefore, engine speed is controlled without the need for the expensive, small tolerance parts of the prior art engines.

The quiet and efficient diesel engine of this invention need not be built entirely from scratch, but instead can be simply and easily made by converting an already existing two-cycle glow-plug engine. This conversion to the diesel engine of this invention involves merely replacing a conventional glow plug head of the glow-plug engine with the diesel head of this invention after first installing a fluorocarbon membrane and a contra piston. In some glow-plug engines, the fluorocarbon membrane rests on a head gasket seat bordering the top of a combustion chamber. In this case, the membrane is held in position by the diesel head itself when it is secured in place. In other glow-plug engines, no head gasket seat is available to support a membrane so a separate liner having a lip is provided. The liner fits inside a diesel head and holds the disc-shaped membrane on its lip.

The diesel engine of this invention is also more efficient than prior art diesel engines. The fluorocarbon membrane acts as a reflective insulator thereby reducing heat loss through surface area dissipation. Because of this increased thermal efficiency, the diesel engine of this invention retains its smooth running characteristics at much greater engine sizes than with prior art two-cycle diesels.

In addition, because the fluorocarbon disc does not retain heat as does a metal surface, unwanted heat is not present between cycles and misfiring is avoided.

Further, the fluorocarbon membrane of this invention provides a safety feature not found in prior art diesel engines. Due to the inherent nature of the fluorocarbon material, the membrane vaporizes at very high temperatures above the normal operating limits thereby permitting overpressurized gas to escape from the combustion chamber and exit from the engine through a gas vent disposed in the diesel head. Because of this gas release, this engine, unlike prior art diesels, does not explode under conditions where abnormally high temperatures may be created.

Finally, the fluorocarbon disc also serves to reduce the noise created by the engine as the disc tends to absorb sound rather than metallically resonate.

Accordingly, a principal object of the present invention is to provide a diesel engine which is inexpensive and easily manufactured.

Another object of the present invention is to provide a diesel engine which can easily be made by converting an existing glow-plug engine.

Another object of the present invention is to provide a diesel engine which has improved operating efficiency over previous diesel engines.

Another object of the present invention is to provide a diesel engine which is safer than existing diesel engines.

Other and more specific objects of the invention will be in part obvious and will in part appear from the following description of the preferred embodiments and claims taken together with the drawings.

DRAWINGS

The same reference numbers refer to the same elements throughout the various Figures.

DESCRIPTION OF THE PREFERRED EMBODIMENT

Figure 1:
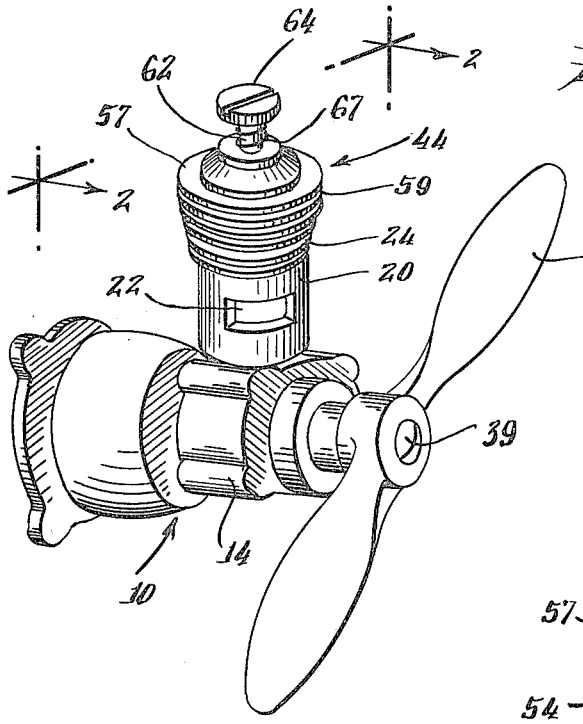
FIG. 1 is a perspective view of a diesel engine according to the invention herein.

Referring now to FIG. 1, a diesel engine according to the invention herein is shown at 10. The diesel engine 10 generally comprises two main elements which are a crankshaft housing 14 and an engine cylinder 20.

As shown in FIG. 1, the engine cylinder 20 is essentially cylindrical and extends upwardly from the approximate midpoint of the housing 14. The lower portion of the engine cylinder 20 near the housing 14 has an exhaust port 22 disposed therein while a series of parallel fins 24 are circumferentially disposed around the upper portion of the engine cylinder 20.

Figure 2:
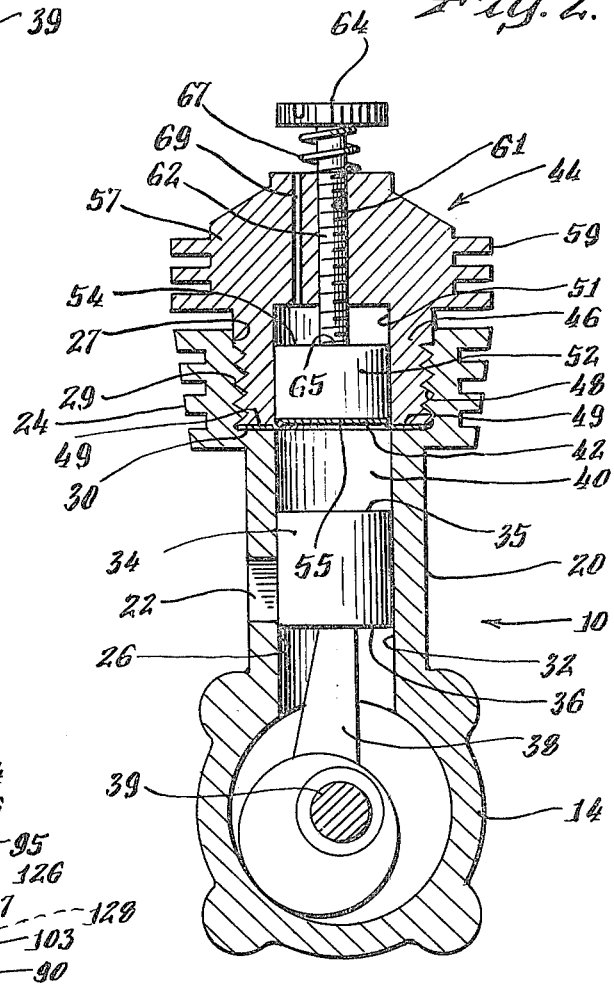
FIG. 2 is an enlarged cross-sectional view of the diesel engine taken along lines 2—2 of FIG. 1.

As shown in FIG. 2, the engine cylinder 20 has a centrally disposed internal bore 26. The internal bore 26 is comprised of two sections which are a head opening 27 and a piston cylinder 32. The head opening 27 extends from the top of the engine cylinder 20 to the piston cylinder 32. The head opening 27 has a series of screw threads 20 on its inside. As the head opening 27 is larger in diameter than the piston cylinder, a lip 30 is formed in the bore 26 at the interface between the head opening 27 and the piston cylinder 32.

The piston cylinder 32 extends downward from the head opening 27 to the inside of the housing 14 as shown in FIG. 2. A movable cylindrical piston 34 is disposed inside the piston cylinder 32. The piston 34 has a top 35 and a bottom 36. The outside of the piston 34 fits flush against the inside of the piston cylinder 32, but the piston is vertically movable with respect to the piston cylinder 32. A connecting rod 38 is attached to the bottom 36 of the piston 34. The end of the connecting rod 38 opposite the piston 34 is connected to a rotatable crankshaft 39. Accordingly, vertical or reciprocal movement of the piston 34 will be transmitted by the connecting rod 38 into a rotational movement of the shaft 39. As shown in FIG. 1, a propeller 16 is attached to the end of the shaft 39 protruding from the housing 14. Consequently, when the piston reciprocates rapidly, the shaft 39 will rotate at a high rate of speed causing the propeller 16 to spin and thereby provide the thrust necessary to move the vehicle (not shown) to which the engine 10 is attached.

As shown in FIG. 2, a combustion chamber 40 is located inside the piston cylinder 32 between the top 35 of the piston 34 and the head opening 27. Reciprocal movement of the piston 34 occurs when the fuel is ignited or exploded in the combustion chamber 40 thereby forcing the piston 34 downward in the piston cylinder 32 away from the explosion. In the diesel engine 10 of this invention, this fuel ignition occurs in the following manner. As the piston 34 moves upward in the piston cylinder 32, the air in the combustion chamber 40 becomes compressed and the gaseous fuel introduced into the chamber becomes subject to the heat created by this air compression. As the piston 34 travels further upward, combustion chamber 40 is further decreased and more heat is created. Eventually when a sufficient amount of heat is present, it will ignite the fuel. This will force the piston 34 downward thereby rotating the shaft 39 in a manner previously described. The exploded gas is ejected through the exhaust port 22. As the piston 34 returns and moves upward in the piston cylinder 32 once again, the cycle is repeated. New fuel enters the combustion chamber 40 through a gas port (not shown) as the piston 34 begins to proceed upwardly. The rate of firing of the engine 10 is, therefore, determined by the amount of heat present in the combustion chamber 40 which is inversely proportional to the size of the combustion chamber 40. Consequently, by varying the size of the combustion chamber 40 the rate of firing of the engine 10 can also be varied.

A disc-shaped fluorocarbon membrane 42 is disposed inside the bore 26 and rests on the lip 30. The membrane 42 seals the head opening 27 from the piston cylinder 32. The fluorocarbon membrane 42, therefore, serves as the top of the combustion chamber 40. The fluorocarbon membrane 42 is flexible and acts as a reflective insulator which reduces heat loss from the combustion chamber 40 and increases the thermal efficiency of the engine 10. Teflon may be used as the material for the membrane 42. As shown in FIG. 2, the membrane 42 has a centrally disposed raised portion. This is a result of the remolding characteristics of the material. Like all plastics, Teflon has the ability to reform under heat and pressure and use in the engine creates this raised section or top hat effect.

As shown in FIG. 2, the membrane 42 is secured in place on the lip 30 by a diesel head 44. The diesel head 44 is essentially cylindrical and has a lower portion 46 and an upper portion 57. The lower portion 46 of the diesel head 44 is adapted to fit into the head opening 27 of the engine cylinder 20. The lower portion 46 of the diesel head 44 has a series of screw threads 48 surrounding its bottom portion, and these screw threads 48 are adapted to be received by the screw threads 29 of the head opening 27. The lower portion 46 of the diesel head 44 also has a bottom edge 49, and when the diesel head 44 is in place in the engine cylinder 20, the bottom edge 49 of the lower portion 46 contacts that portion of the fluorocarbon membrane 42 supported by the lip 30 and secures the membrane 42 in place. A gas-tight seal is, therefore, created between the combustion chamber 40 and the head opening 27. The lower portion 46 of the diesel head 44 also has a contra piston opening 51 which extends from the bottom edge 49 to the upper portion 57 of the diesel head 44. The contra piston opening 51 is cylindrical and concentrically aligned with the piston cylinder 32 when the diesel head 44 is in place. As shown in FIG. 2, a solid cylindrical contra piston 52 having a top 54 and a bottom 55 is movably disposed inside the contra piston opening 51. The contra piston 52 is relatively loose fitting inside the contra piston opening 51, and when the diesel head 44 is in place, the bottom 55 of the contra piston 52 rests upon the fluorocarbon membrane 42.

The upper portion 57 of the diesel head 44 is of somewhat greater diameter than the lower portion 46, and the upper portion 57 has a series of parallel fins 59 circumferentially disposed around it, as best shown in FIG. 2. The upper portion 57 of the diesel head 44 also has a centrally disposed screw hole 61 which extends entirely through the upper portion 57 to the contra piston opening 51. The screw hole 61 is interiorly screw threaded throughout its length. A compression screw 62 is mounted in the screw hole 61 and when in place it extends from above the diesel head 44 into the contra piston opening 51. The compression screw 62 has a knob 64 on its upper end, and when the screw 62 is in place, the knob 64 is positioned outside and above the diesel head 44. The compression screw 62 has a tip 65 opposite the knob 64. When the compression screw 62 is in place, the tip 65 contacts the top 54 of the contra piston 52 inside the contra piston opening 51. Consequently, when the compression screw 62 is rotated clockwise, the screw tip 65 will be forced downward against the top 54 of the movable contra piston 52 causing it to move downward. This downward movement of the contra piston 52 correspondingly forces the flexible, fluorocarbon membrane 42 downward into the piston cylinder 32. The movement of the fluorocarbon membrane 42 in this manner reduces the size of the combustion chamber 40, and, as previously explained, this will increase the internal heat of the chamber 40 and increase the rate of firing of the engine 10. Correspondingly, when the compression screw 62 is rotated in the counter-clockwise direction, the tip 65 of the screw 62 moves upward away from the contra piston 52 allowing the fluorocarbon membrane 42 to flex back to its original position or an intermediate one thereby increasing the combustion chamber's size. This will decrease the heat in the combustion chamber 40, and, therefore, slow the engine's firing rate. Accordingly, the compression screw 62 can be set for any incremental change in combustion chamber size which is desired, and this is the manner in which the speed of the engine 10 is controlled.

As a very small size change in the combustion chamber 40 is sufficient to produce a noticeable difference in engine speed, a compression spring 67 is provided between the knob 64 of the screw 62 and the upper portion 57 of the diesel head 44 to maintain the engine speed setting. The tension of the spring 67 on the screw 62 and diesel head 44 helps to prevent any inadvertent rotation of screw 62 which can even occur due to engine vibration. Other devices can be used, however, to secure the screw in its set position.

The diesel head 44 also has a gas outlet vent 69 which operates as a safety valve when safe operating temperatures are exceeded. As shown in FIG. 2, the gas vent 69 extends through the upper portion 57 of the diesel head 44 to the contra piston opening 51. The vent 69 is shown parallel to the screw hold 61, but can be disposed at an angle or out the side. If during engine operation the temperature in the combustion chamber 40 should become too high, the excessive heat will cause the fluorocarbon membrane 42 to vaporize. The trapped and overpressurized gas in the combustion chamber 40 then escapes around the loose fitting contra piston 52 and exits out of the diesel head 44 through the gas vent 69. This prevents severe damage to the engine which might otherwise result if the pressurized gas could not escape. At the same time, the engine is easily made operable again by merely replacing the membrane.

Figure 3:
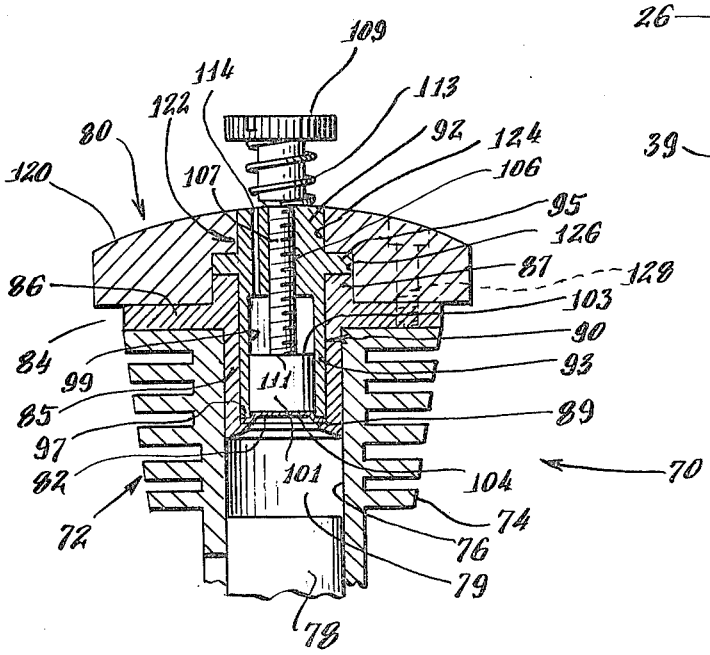
FIG. 3 is a cross-sectional view of another diesel engine according to the invention herein.

Referring now to FIG. 3, another embodiment of the diesel engine of the invention is shown at 70. The diesel engine 70 comprises an engine cylinder 72 having a series of parallel fins 74 circumferentially disposed around its upper portion. The engine cylinder 72 also has a centrally disposed, cylindrical internal bore 76, which unlike the interal bore 26 of the engine cylinder 20 of the first embodiment shown in FIG. 2, is comprised of a single section having the same diameter throughout. A piston 78 is movably disposed inside the bore 76, and attached to a rotatable crankshaft (not shown) in the same manner as in the previous embodiment, and a combustion chamber 79 for ignition of fuel is located in the bore 76 above the piston 78.

A diesel head 80 comprising a liner 84, a diesel head insert 90 and a cover 120 is provided which supports a disc-shaped fluorocarbon membrane 82. The hollow liner 84 is cylindrical and, as shown in FIG. 3, has a lower section 85 which fits into the top of the internal bore 76. The lower section 85 of the liner 84 extends from an inwardly projecting lip 89 at the piston end to an annular flange 86. When the liner 84 is in place in the bore 76, the flange 86 is positioned adjacent to the top of the engine cylinder 72. As the diameter of the flange 86 is greater than that of the bore 76, the flange 86 prevents the liner 84 from being entirely inserted into the bore 76. The liner 84 also has a cylindrical upper section 87 which extends from the flange 86 opposite the lower section 85. When the diesel head 80 is in place, the upper section 87 remains outside the engine cylinder 72.

The fluorocarbon membrane 82 is placed on and supported by the lip 89 thereby forming the top of the combustion chamber 79. The fluorocarbon membrane 82 is held in place by the diesel head insert 90 which is substantially cylindrical and comprised of an upper portion 92 and a lower portion 93 separated by an insert flange 95. The lower portion 93 of the diesel head insert 90 has a bottom edge 97 and is disposed inside the liner 84 so that the bottom edge 97 holds the fluorocarbon membrane 82 against the lip 89 of the liner 84. This creates a gas-tight seal. At the same time, the insert flange 95 is positioned adjacent to the top of the upper section 87 of the liner 84, as shown in FIG. 3.

The lower portion 93 of the diesel head insert 90 has a centrally disposed, cylindrical contra piston opening 99 which extends from the bottom edge 97 almost to the insert flange 95. The diameter of the contra piston opening 99 is the same as the diameter of the lower section 85 of the liner 84 at the lip 89. A solid, cylindrical contra piston 101 having a top 103 and a bottom 104 is movably disposed inside the contra piston opening 99. The contra piston 101 is relatively loose fitting inside the opening 99 and its bottom 104 rests on the fluorocarbon membrane 82.

The upper portion 92 of the insert 90 has a centrally disposed screw hole 106 which extends entirely through the diesel head insert 90 to the contra piston opening 99. A compression screw 107 is rotatably mounted in the screw hole 106, and when in place, it extends from above the diesel head 80 into the contra piston opening 99. The compression screw 107 has a knob 109 at its upper end, outside of the diesel head 80, and a tip 111 at the end opposite the knob 109. As shown in FIG. 3, the tip 111 contacts the top 103 of the contra piston 101. Accordingly, as in the previous embodiment, rotation of the screw 107 will cause movement in the contra piston 101, and a similar movement in the flexible, fluorocarbon membrane 82. As before, the movement of the membrane 82 will either decrease or increase the relative size of the combustion chamber 79 thereby controlling the rate of firing of the diesel engine 70. A tension spring 113 is provided between the diesel head insert 90 and the knob 109 to aid in holding the compression screw 107 in its selected position. Also, as in the previous embodiment, a gas vent 114 is provided as a safety feature to allow the overpressurized gas to escape from the engine 70.

The cover 120 secures the diesel head insert 90 to the liner 84. The cover 120 is substantially circular and has a centrally disposed cover hole 122. The cover hole 122 has a top section 124 and a bottom section 126. The top section 124 has a diameter slightly larger than the outside diameter of the upper portion 92 of the diesel head insert 90, while the bottom section 126 has a diameter slightly larger than that of the upper section 87 of the liner 84. As shown in FIG. 3, when the cover 120 is in place, the bottom of the cover 120 fits against the top edge of the flange 86 of the liner 84, and a bolt 128 holds the cover to the flange 86 thereby securing the cover 120, the liner 84 and the diesel head insert 90 together.

As shown in FIG. 3, the diesel head 80 is held in place in the engine cylinder 72 by a force fit between the lower section 85 of the liner 84 and the bore 76. This fit is gas tight. It is also possible, however, to secure the diesel head 80 to the engine cylinder 72 by the use of matching screw threads on the lower section 85 and the inside of the bore 76 or any other suitable attaching means.

Existing glow-plug engines can be easily converted to the diesel engine of this invention. These prior art engines employ a glow plug to ignite the fuel in the combustion chamber and the glow plug is supported by a glow plug head mounted on an engine cylinder similar to those of this invention. Therefore, the diesel head and fluorocarbon membrane of this invention can be inserted in place of the conventional head and glow plug thereby converting the engine. In conventional glow-plug engines having a lip in its bore, the diesel head of the first embodiment as shown in FIG. 2 would be used. In those glow-plug engines where no lip is available to support a membrane, the diesel head of the second embodiment as shown in FIG. 3 would be employed.

The diesel engine of this invention, therefore, can be built in the manner as previously described or an existing glow-plug engine can be converted to the diesel engine of this invention. Further, because of the increased thermal efficiency of the diesel engine of this invention, the displacement size of this diesel engine is not as restricted as the two-cycle diesel engines of the prior art. The unconverted, conventional engine can also employ the membrane only as a safety valve in the same manner as previously described.

From the foregoing description of the invention and discussion of the prior art engines, the numerous advantages and improvements incident in this invention will now be apparent to those skilled in the art.

Accordingly, the above description of the invention is to be construed as illustrative only, rather than limiting. The invention is limited only by the scope of the following claims.

I claim:

1. A diesel engine comprising an engine cylinder having a cylindrical internal bore, said bore containing a movable, cylindrical piston having a top and a bottom, a combustion chamber being disposed inside said bore above said top of said piston, the rate of firing of said engine being inversely proportional to the size of said combustion chamber, and a flexible membrane being disposed in said bore and partially defining said combustion chamber so that the size of said combustion chamber is variable by selectively flexing said membrane, said membrane sublimating when safe operating temperatures are exceeded inside said combustion chamber thereby allowing any gas in said combustion chamber to escape from said combustion chamber.

2. A diesel engine as defined in claim 1 wherein said flexible membrane forms a gas-tight seal with the remainder of said combustion chamber, and said membrane being made of insulating material to prevent heat loss from said combustion chamber.

3. A diesel engine as defined in claim 2 wherein said membrane is comprised of a thin sheet of fluorocarbon material.

4. A diesel engine as defined in claim 1 wherein said flexible membrane is disposed across said bore above said top of said piston, and said combustion chamber extends from said top of said piston to said membrane.

5. A diesel engine as defined in claim 4 wherein said bore has a lip disposed above said top of said piston, said lip supporting said flexible membrane.

6. A diesel engine as defined in claim 5 wherein said membrane is shaped like a disc and held in place on said lip by a diesel head at least a portion of a diesel head fitting into said bore opposite said top of said piston.

7. A diesel engine as defined in claim 6 wherein said diesel head comprises a lower portion having a bottom edge and an upper portion, said lower portion fitting into said bore so that said membrane is held between said bottom edge and said lip.

8. A diesel engine as defined in claim 7 wherein said means for flexing said membrane comprises a cylindrical contra piston opening disposed in said lower portion and positioned above the central portion of said membrane and extending from said bottom edge to said upper portion, a movable contra piston disposed in said contra piston opening and resting on the central portion of said membrane, and means for moving said contra piston against said flexible membrane.

9. A diesel engine as defined in claim 8 wherein said means for moving said contra piston comprises a compression screw rotatably mounted in said upper portion of said diesel head so that one end of said screw contacts said contra piston opposite said membrane inside said contra piston opening, whereby rotation of said compression screw in one direction forces said contra piston downward into said membrane causing said membrane to flex toward said piston thereby decreasing the size of said combustion chamber and increasing the rate of firing of said engine, and rotation of said screw in the opposite direction moves said end of said screw away from said contra piston allowing said membrane to flex back toward its original position thereby increasing the size of said combustion chamber and decreasing the rate of firing of said engine.

10. A diesel engine as defined in claim 7 wherein a gas vent is disposed in said upper portion of said diesel head, said gas vent extending from said contra piston opening to the top of said upper portion, said gas vent passing any gas released by the vaporization of said membrane to the outside of said engine.

11. A diesel engine as defined in claim 1 wherein one end of a connecting rod is attached to said bottom of said piston, the end of said connecting rod opposite said piston being connected to a rotatable crankshaft so that reciprocal movement of said piston in said bore is translated to rotational movement of said shaft.

12. A diesel engine as defined in claim 4 wherein said engine has a diesel head at least a portion of which having a lip fits into said bore opposite said top of said piston, said lip supporting said flexible membrane.

13. A diesel engine as defined in claim 12 wherein said diesel head comprises a hollow cylindrical liner, said liner having an upper section and a lower section, said lower section having said lip inwardly disposed at its end opposite said upper section, said lower section fitting into said bore so that said lip is positioned above said top of said piston.

14. A diesel engine as defined in claim 13 wherein said membrane is held in place on said lip by a diesel head insert, said diesel head insert having an upper portion and a lower portion, said lower portion of said diesel head insert having a bottom edge and fitting inside said liner so that said membrane is held between said bottom edge and said lip.

15. A diesel engine as defined in claim 14 wherein said means for flexing said membrane comprises a cylindrical contra piston opening disposed in said lower section and positioned above the central portion of said membrane and extending from said bottom edge to said upper section, a movable contra piston disposed in said contra piston opening and resting on the central portion of said membrane, and means for moving said contra piston against said flexible membrane.

16. A diesel engine as defined in claim 15 wherein said means for moving said contra piston comprises a compression screw rotatably mounted in said upper section of said diesel head so that one end of said screw contacts said contra piston opposite said membrane inside said contra piston opening, whereby rotation of said compression screw in one direction forces said contra piston downward into said membrane causing said membrane to flex toward said piston thereby decreasing the size of said combustion chamber and increasing the rate of firing of said engine, and rotation of said screw in the opposite direction moves said end of said screw away from said contra piston allowing said membrane to flex back toward its original position thereby increasing the size of said combustion chamber and decreasing the rate of firing of said engine.

17. A diesel engine as defined in claim 15 wherein a gas vent is disposed in said upper section of said diesel head insert, said gas vent extending from said contra piston opening to the top of said upper section, said gas vent passing any gas released by the vaporization of said membrane to the outside of said engine.

18. A diesel engine as defined in claim 14 wherein said diesel head insert and said liner are secured together by a cover.

19. A method for converting a two-cycle glow-plug engine to a diesel engine, said glow-plug engine comprising an engine cylinder having a central cylindrical bore, a cylindrical piston movably mounted in said bore, said piston having a top and a bottom, said bottom being attached to one end of a connecting rod, the other end of said connecting rod being attached to a rotatable crankshaft in such a manner that reciprocal movement of said piston in said bore causes rotational movement of said crankshaft, a combustion chamber disposed in said bore above said top of said piston, a glow plug head mounted in the end of said bore opposite said piston, said glow plug head sealing said combustion chamber and supporting a glow plug for ignition of fuel in said combustion chamber, wherein said method comprises:

A. removing said glow plug head and said glow plug;
B. inserting a flexible, heat-reflective membrane into said bore;
C. positioning said flexible membrane in said bore so that said membrane is disposed above said top of said piston so as to become the top of said combustion chamber;
D. securing said membrane in place forming a gas-tight seal with the remainder of said combustion chamber;
E. securing to said engine cylinder a diesel head having means for flexing said membrane whereby the decreasing and increasing of the size of said combustion chamber may be controlled.

20. A method for converting a two-cycle glow-plug engine to a diesel engine as defined in claim 19 wherein the step of positioning said flexible membrane in said bore includes placing said membrane on a lip in said bore.

21. A method for converting a two-cycle glow-plug engine to a diesel engine as defined in claim 20 wherein the step of securing said membrane in place in said bore includes holding said membrane between said lip and a portion of said diesel head.

22. A method for converting a two-cycle glow-plug engine to a diesel engine as defined in claim 19 wherein the step of positioning said flexible membrane in said bore includes mounting said membrane on a lip of said diesel head and inserting the lip end of said diesel head into said bore.

23. A method for converting a two-cycle glow-plug engine to a diesel engine as defined in claim 19 wherein the step of positioning said flexible membrane in said bore includes inserting a hollow liner having an inwardly disposed lip into said bore above said piston and mounting said membrane on said lip.

24. A method for converting a two-cycle glow-plug engine to a diesel engine as defined in claim 23 wherein the step of securing said membrane in place includes inserting a diesel head insert into said liner, and holding said membrane between said lip of said liner and a portion of said diesel head insert.

25. A diesel engine comprising an engine cylinder having a cylindrical internal bore, said bore containing a movable, cylindrical piston having a top and a bottom, a combustion chamber being disposed inside said bore above said top of said piston, the rate of firing of said engine being inversely proportional to the size of said combustion chamber, and a deformable membrane being disposed in said bore and partially defining said combustion chamber so that the size of said combustion chamber is variable by selectively and elastically deforming said membrane in shear along the periphery of said bore, and means for selectively deforming said membrane.

26. The diesel engine of claim 25 wherein said membrane is comprised of a thin sheet of fluorocarbon material.

* * * * *